United States Patent [19]

Riegler et al.

[11] 4,200,266

[45] Apr. 29, 1980

[54] MIXING ARRANGEMENT

[75] Inventors: Ernst Riegler, Enns; Manfred Schmidt, Linz, both of Austria

[73] Assignee: Voest-Alpine Aktiengesellschaft, Linz, Austria

[21] Appl. No.: 934,945

[22] Filed: Aug. 18, 1978

[30] Foreign Application Priority Data

Sep. 2, 1977 [AT] Austria ..... 6322/77

[51] Int. Cl.[2] ..... B22D 35/00; C21B 11/00

[52] U.S. Cl. ..... 266/236; 164/337

[58] Field of Search ..... 266/142, 143, 160–166, 266/168, 195–198, 227–230, 240, 248, 900, 901, 236; 164/335–337; 137/579

[56] References Cited

U.S. PATENT DOCUMENTS

| | | | |
|---|---|---|---|
| 998,787 | 7/1911 | Lohe | 266/166 |
| 1,969,325 | 8/1934 | Pugh | 266/240 |
| 2,039,738 | 5/1936 | Pugh | 164/337 |
| 3,032,841 | 5/1962 | Sylvester | 164/337 |
| 3,433,472 | 3/1969 | Chang et al. | 266/195 |
| 3,441,261 | 4/1969 | Sommer | 266/900 |

FOREIGN PATENT DOCUMENTS

| | | | |
|---|---|---|---|
| 2052101 | 4/1972 | Fed. Rep. of Germany | 164/337 |

*Primary Examiner*—L. Dewayne Rutledge
*Assistant Examiner*—Peter K. Skiff
*Attorney, Agent, or Firm*—Brumbaugh, Graves, Donohue & Raymond

[57] ABSTRACT

In a mixing arrangement including a mixing chamber stationarily arranged on a base or mounted on a vehicle, the mixing chamber is connected, in communicating vessel manner, with at least one pouring chamber pivotable relative to the mixing chamber, by a passage arranged in the vicinity of the bottom of the mixing chamber, and the pivot axis extends also near the bottom.

12 Claims, 3 Drawing Figures

MIXING ARRANGEMENT

BACKGROUND OF THE INVENTION

The invention relates to a mixer, in particular a pig iron mixer, having a mixing chamber fixed on a base or mounted on a vehicle.

It has been known to design large-space pig iron mixers stationarily, i.e. fixed on a base, in order to avoid a tiltable mounting and a tilting drive which, with metallurgical large-space vessels, are considerably complex. With a known stationary pig iron mixer, the pig iron is removable out of the mixer by means of a pressure gas, the pig iron being pressed into a pouring channel immovably mounted on the pig iron mixer by means of pressure gas introduced into the mixer chamber. The gas pressure to be produced within the mixing chamber during removal of the pig iron has to be taken into consideration when dimensioning the walls of the pig iron mixer. Besides, care has to be taken assure the gas tightness of the jacket with a pig iron mixer of this kind, in particular at its charging hole. Difficulties also result from the elastic gas cushion present within the mixer chamber when exactly dosing the amount of pig iron to be removed from the mixer.

SUMMARY OF THE INVENTION

The invention aims at avoiding these difficulties and has as its object to provide a stationary mixer, i.e. a mixer for which no tiltable mounting and no tilting drive for the mixing chamber are necessary, in which the amount of melt to be removed can be well dosed; in which no care has to be taken with respect to gas tightness and in which only the weight of the melt has to be taken into consideration when dimensioning its walls.

These objects are achieved according to the invention in that the mixing chamber is connected with at least one pouring chamber pivotable relative to the mixing chamber by means of a passage arranged in the vicinity of its bottom, the tilting axis of the at least one pouring chamber extending also in the vicinity of the bottom, preferably through the passage.

In this case, the pouring chamber is advantageously designed as a pipe knee comprising at its upper end at least one lateral pouring lip.

Suitably the bottom of the mixing chamber is designed to be inclined towards the passage.

According to a preferred embodiment the mixing chamber is designed cylindrically and is provided, on its two face walls, with one pipe knee each. The pivot axis of each pipe knee is arranged in the middle of the passage and is parallel to the cylindrical axis. The length of the pipe knee approximately corresponding to the diameter of the mixing chamber. By this means, it is possible to simultaneously fill two ladles with pig iron.

It is furthermore advantageous, if the pouring chamber is pivotable from a vertical position in both directions by at least 90° into pouring positions. By this arrangement it is possible to remove pig iron out of one mixer from two crane areas.

In order to be able to carry out repair work at the pouring chamber without interrupting the operation of the mixer, the passage is suitably lockable by a locking device, such as a slide.

According to a further preferred embodiment, the pouring chamber is provided with a bob weight lying diametrically opposite the same along its pivot axis, the common center of gravity of the bob weight and the pouring chamber filled with pig iron being below the pivot axis of the pouring chamber when the latter is in the vertical position. This has the advantage that the pouring chamber will automatically return into its resting position on failure of the pivot drive and an undesired flowing out of the melt is safely prevented.

As a pivot drive advantageously two pressure medium cylinders, preferably telescope cylinders, are provided. They are arranged symmetrically to the pouring chamber with one end articulately attached to the frame and the other end articulately to the pouring chamber.

For removing the slag from the mixing chamber a skimmer opening is suitably provided, which opening is closeable by means of a shutting device.

BRIEF DESCRIPTION OF THE DRAWINGS

The invention will now be described in more detail by way of one embodiment and with reference to the accompanying drawings, wherein.

DESCRIPTION OF AN EXEMPLARLY EMBODIMENT

Figure 1:
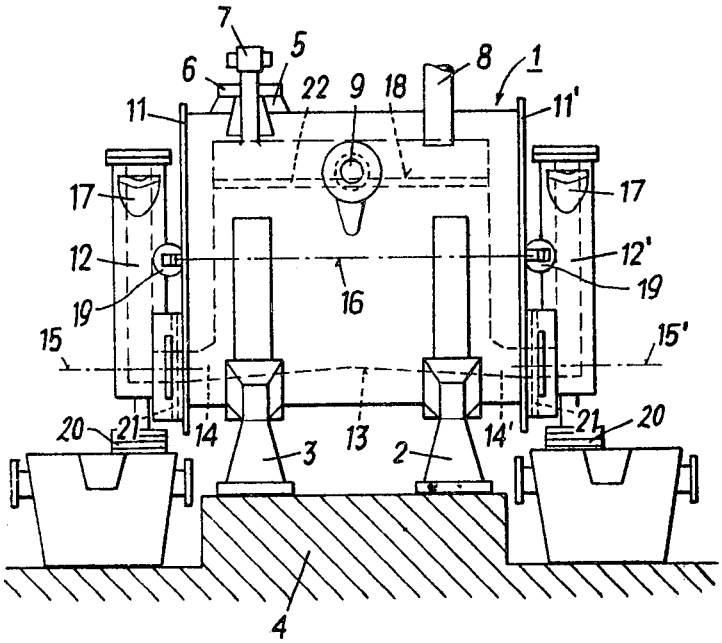
FIG. 1 is a side view of a pig iron mixer in schematic illustration.

A mixing chamber 1 of a pig iron mixer is shown having a circular-cylindrical cross section and being stationarily mounted on a base 4 via base supports 2 and 3. Filling of the pig iron mixer is effected via a filling opening 5 closeable with a lid 6 by means of a lid lifting mechanism 7. For heating of the mixer chamber a heating device 8 is provided. Removal of the slag is effected by a skimmer opening 9 closeable by a shutting slide 10. For removing the pig iron, a pouring chamber 12, 12' designed as a pipe knee is provided on each of the two face walls 11, 11', each of which is connected with the inside of the mixing chamber by a passage 14, 14' arranged in the vicinity of the bottom 13 of the chamber. The pouring chambers 12 and 12' are fastened to the mixing chamber to be pivotable about the axes 15 and 15'. The axes are arranged in the middle of the passages an are parallel to the cylinder axis 16 of the mixing chamber 1. The bottom 13 of the mixing chamber is inclined towards the passages 14, 14', so that the passages are situated at the lowermost areas of the pig iron mixer. At the upper ends of the pouring chambers 12, 12' pouring lips 17 are laterally arranged. The vertical section of each pouring chamber extends slightly higher than the maximally admissible filling level, which is denoted by 18 in FIG. 1.

Figure 2:
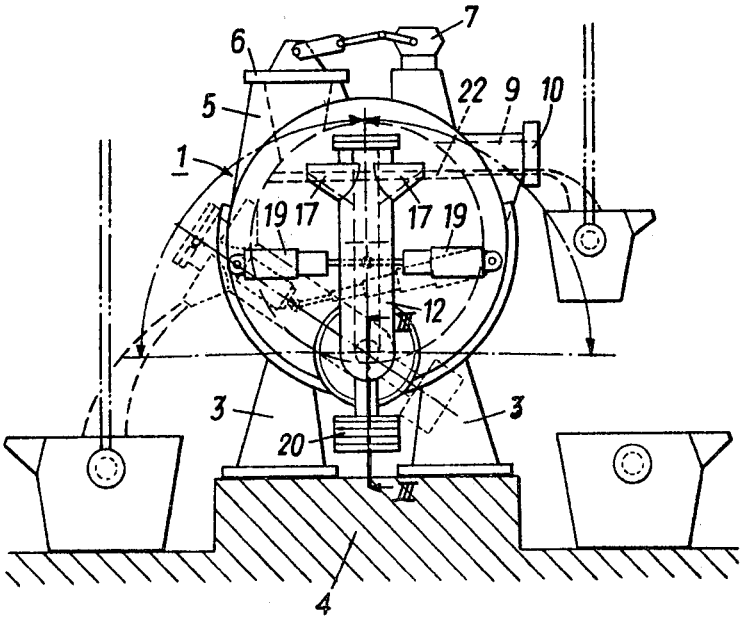
FIG. 2 is a front view of a pig iron mixer in schematic illustration.

Both pouring chambers 12 and 12' are pivotable from their vertical resting position, which in FIG. 2 is illustrated in full lines, in both directions by at least 90° into pouring positions, which in FIG. 2 are shown by dot-and-dash lines. As a pivot drive, two telescope cylinders 19 arranged symmetrically to the pouring chambers are each provided, one end of each of these chambers is pivotally fastened to fixed points on the mixing chamber and the other end of each is articulately connected to the pouring chambers 12, 12'. For removing the pig iron, the pouring chambers are tilted by means of the telescope cylinders 19 until the pig iron leaves the pouring lip 17 in a calm stream i.e. the piston rod of one cylinder extends while the other retracts in order to pivot the pouring chambers.

In order to safely avoid an undesired flowing out of pig iron during a failure of the pivot drive, a bob weight 20 is provided at each pouring chamber on its lower end, which weight is dimensioned such that the common centre of gravity, of the bob weight 20 and the pouring chamber 12 and 12' filled with pig iron, is situated below the pivot axis 15 when the pouring chamber is in the resting position.

Figure 3:
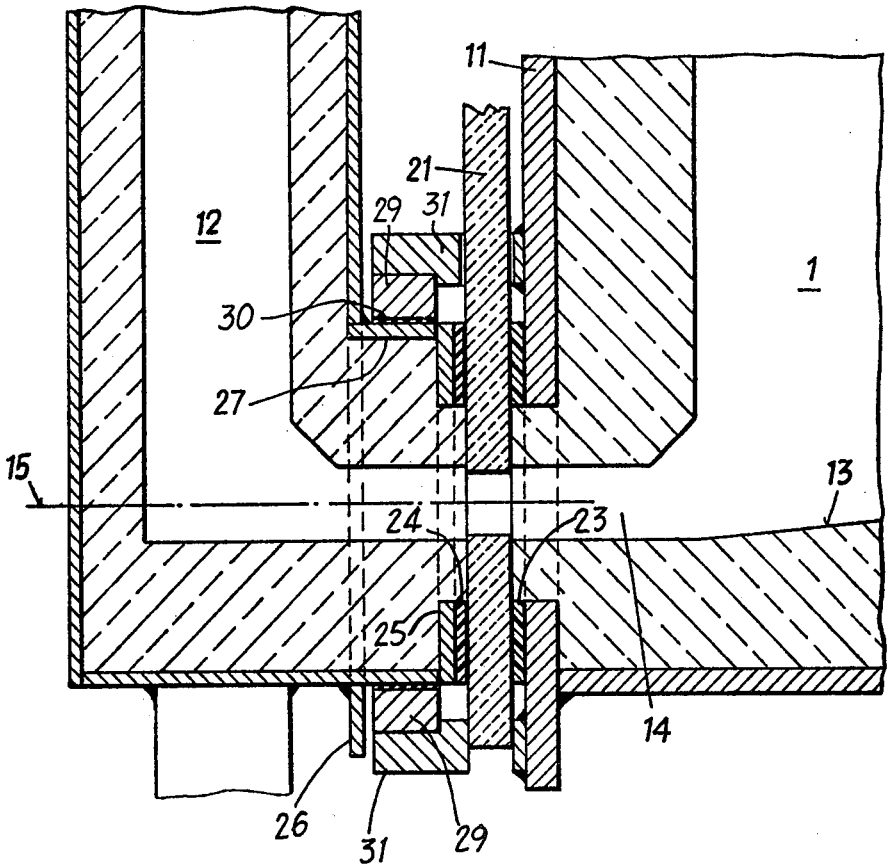
FIG. 3 is a section along line III-III of FIG. 2 on an enlarged scale.

In order to be able to carry out service and repair work at one of the pouring chambers, each passage 14 and 14' is closeable by a slide 21, which is illustrated in more detail in FIG. 3. This slide is guided between sealing rings 23, 24 which are fixed to mixing chamber 1. An annular plate 25 attached to pouring chamber 12 makes sliding contact with ring 24. The outer wall 27 of pouring chamber 12, and hence the pouring chamber, is rotatably supported via bushing 30 within a ring-shaped plate 29 that is fastened to the mixing chamber by annular ring 31. End pieces (not shown) are screwed to ring 31 so as to trap a flange 26 of the pouring chamber between them and ring 31, thereby holding the pouring chamber to the mixing chamber. After closing of the slide 21 the pouring chamber to be repaired can be removed by releasing the screws holding the end pieces to ring 31 and it can be replaced by an intact one.

As can be seen particularly from FIG. 2, removal of the pig iron can be effected from two sides, i.e. removal is possible in two crane areas and thus from two different halls.

In FIG. 1 the slag floating on the pig iron and denoted by 22 is illustrated. The face walls 11, 11' of the mixing chamber act as slag separators, so that only slag-free pig iron will flow into each pouring chamber.

The pig iron mixer according to the invention is not limited to any special outer design and position, the cylindrical mixing chamber can be placed on the base also with its axis vertical.

What we claim is:

1. A mixing arrangement, in particular a pig iron mixer, comprising a mixing chamber having a bottom and at least one passage provided near said bottom, at least one pouring chamber detachably connected to said mixing chamber via said passage, said at least one pouring chamber, while connected to said mixing chamber, being pivotable relative to said mixing chamber about a pivot axis, said pivot axis extending near said bottom of said mixing chamber, and slide locking means in said at least one passage of said mixing chamber for sealing said passage at least when the pertaining pouring chamber is detached from said passage.

2. A mixing arrangement as set forth in claim 1, further comprising a base, said mixing chamber being stationarily mounted on said base.

3. A mixing arrangement as set forth in claim 1, further comprising a vehicle, said mixing chamber being mounted on said vehicle.

4. A mixing arrangement as set forth in claim 1, wherein said pivot axis extends through said at least one passage.

5. A mixing arrangement as set forth in claim 1, wherein said bottom of said mixing chamber is designed so as to be inclined towards said at least one passage.

6. A mixing arrangement as set forth in claim 1, wherein said at least one pouring chamber is designed as a pipe knee, at least one lateral pouring lip being provided on said pipe knee at the upper end thereof.

7. A mixing arrangement as set forth in claim 5, wherein said mixing chamber is cylindrically shaped and has two face walls, a certain diameter and a cylinder axis, and wherein two pipe knees and two passages are provided, one pipe knee being provided on each of said face walls of said mixing chamber, the pivot axis of each pipe knee being arranged in the middle of the passage allocated thereto and parallel to said cylinder axis, said two pipe knees each having a length approximately corresponding to said diameter of said mixing chamber, each pipe knee being pivotable independently of the other and the respective passages leading to said pipe knees being closeable by separate slide locking means independently of each other.

8. A mixing arrangement as set forth in claim 1, wherein said at least one pouring chamber is pivotable from a vertical position by at least 90° into each one of two pouring positions.

9. A mixing arrangement as set forth in claim 1, further comprising a pivot drive for pivoting said pouring chamber relative to said mixing chamber, said pivot drive including two pressure medium cylinders symmetrically arranged with respect to said at least one pouring chamber, one end of each of said two pressure medium cylinders being articulately connected to said mixing chamber and the other end of each being articulately connected to said one pouring chamber.

10. A mixing arrangement as set forth in claim 9, wherein said two pressure medium cylinders are telescope cylinders.

11. A mixing arrangement as set forth in claim 1, further comprising a skimmer opening provided on the mixing chamber, and a closing device, said skimmer opening being closeable by said closing device.

12. A mixing arrangement, in particular a pig iron mixer, comprising a mixing chamber having a bottom and at least one passage provided near said bottom, at least one pouring chamber detachably connected to said mixing chamber via said passage, said at least one pouring chamber, while connected to said mixing chamber, being pivotable relative to said mixing chamber about a pivot axis, said pivot axis extending near said bottom of said mixing chamber, slide locking means in said at least one passage of said mixing chamber for sealing said passage at least when the pertaining pouring chamber is detached from said passage, and a bob weight provided on said at least one pouring chamber, said bob weight being positioned diametrically opposite said at least one pouring chamber along its pivot axis, said at least one pouring chamber, when filled with pig iron, and said bob weight having a common center of gravity, said common center of gravity being below said pivot axis of said at least one pouring chamber in the vertical position thereof.

* * * * *

UNITED STATES PATENT AND TRADEMARK OFFICE

CERTIFICATE OF CORRECTION

PATENT NO. : 4,200,266

DATED : Apr. 29, 1980

INVENTOR(S) : Riegler et al.

It is certified that error appears in the above-identified patent and that said Letters Patent are hereby corrected as shown below:

Col. 1, line 53, "corresponding" should read --corresponds--.

Col. 2, line 11, "articulately to" should read --articulately connected to--;

line 27, "EXEMPLARLY" should read --EXEMPLARY--;

line 45, "The axes" should read --These axes--;

line 46, "an" should read --and--.

Col. 3, line 8, "chamber" should read --chambers--;

line 38, after "position" change the comma to a semi-colon.

Col. 4, line 8, "claim 5" should read --claim 6--.

Signed and Sealed this

First Day of July 1980

[SEAL]

Attest:

SIDNEY A. DIAMOND

Attesting Officer

Commissioner of Patents and Trademarks